US005206038A

United States Patent [19]

Yonezawa

[11] Patent Number: 5,206,038

[45] Date of Patent: Apr. 27, 1993

[54] CLAMPING APPARATUS

[75] Inventor: Keitaro Yonezawa, Kobe, Japan

[73] Assignee: Kabushiki Kaisha KOSMEK, Japan

[21] Appl. No.: 808,007

[22] Filed: Dec. 16, 1991

[30] Foreign Application Priority Data

Dec. 28, 1990 [JP] Japan ..... 2-417580

[51] Int. Cl.[5] ..... B28B 1/00

[52] U.S. Cl. ..... 425/450.1; 425/595

[58] Field of Search ..... 425/450.1, 451.4, 595, 425/193, 195; 100/918

[56] References Cited

U.S. PATENT DOCUMENTS 5,118,269 6/1992 Klose et al. ..... 425/195

FOREIGN PATENT DOCUMENTS 1576097 10/1969 Fed. Rep. of Germany .

3838995 6/1989 Fed. Rep. of Germany .

1-154833 6/1989 Japan .

2184488 6/1987 United Kingdom .

8806684 9/1988 World Int. Prop. O. .

*Primary Examiner*—Bernard Nozick

*Attorney, Agent, or Firm*—Bacon & Thomas

[57] ABSTRACT

A wedge type locking member (27) is brought into contact with a first piston (12) for clamping by means of a pushing spring (28). Thereby, the first piston (12) is prevented from returning from the clamping position (X) to the unclamping position (Y). The locking member (27) is provided with two pressure receiving surfaces (F)(S) having substantially equal areas. A fluid pressure within a first actuation chamber (13) for clamping acts upon these pressure receiving surfaces (F)(S). The locking condition of the locking member (27) is cancelled by means of a second piston (39).

4 Claims, 7 Drawing Sheets

CLAMPING APPARATUS

BACKGROUND OF THE INVENTION

1. Field of the Invention

The present invention relates to a clamping apparatus adapted to clamp an object to be clamped or fixed (referred as to a clamped object hereinafter) such as a metal mould, a work pallet and the like onto a fixed angular table of a processing machine such as an injection moulding machine, a machining center and so on, and more specifically to a fluid clamping apparatus of the type having a clamping lock means, which clamping lock means is adapted to operate so as to prevent the clamped object from being unclamped by an external force when a clamping fluid pressure abnormally lowers.

2. Description of Prior Art

Such a clamping apparatus is described in Japanese Patent Laid Open Publication No. 1 - 154833. As shown in FIG. 12, the clamping apparatus has a following basic construction.

That is, a first cylinder 309 for clamping is provided with a first piston 312 and a first actuation chamber 313. The first piston 312 is adapted to be advanced from an unclamping position Y (a figure depicted by an alternate long and two short dashes line) to a clamping position X (a figure depicted by a solid line) by means of a fluid pressure within the first actuation chamber 313. A lock chamber 326 is communicated crosswise with the first actuation chamber 313, and a wedge-type locking member 327 is inserted into the lock chamber 326. The locking member 327 is adapted to be changed over between a locking position M (a figure depicted by a solid line) where it has been advanced into the first actuation chamber 313 and a unlocking position N (a figure depicted by an alternate long and two short dashes line) where it has been retracted into the lock chamber 326. A second cylinder 329 for unlocking is provided with a second piston 339 and a second actuation chamber 340. The locking member 327 is adapted to be actuated from the locking position M to the unlocking position N by means of a fluid pressure within the second actuation chamber 340 through the second piston 339.

In the above-mentioned basic construction, a mechanism for changing over the locking member 327 is constructed as follows, as shown in FIG. 12.

That is, the second actuation chamber 340 is formed below the second piston 339, and a locking actuation chamber 393 is formed above the piston 339. A fluid pressure supply/discharge port 394 is communicated with the locking actuation chamber 393, and a locking push spring 395 is mounted in the locking actuation chamber 393.

Then, when a clamping arm 307 is changed over from an unclamping condition (a figure depicted by an alternate long and two short dashes line) to a clamping condition (a figure depicted by a solid line), a pressurized fluid is discharged from a second supply/discharge port 341 of the second actuation chamber 340 and is supplied to a first supply/discharge port 315 and to the fluid pressure supply/discharge port 394 for locking. Thereupon, by means of a fluid pressure within the first actuation chamber 313 the first piston 312 is advanced leftwards from the unclamping position Y, so that the clamping arm 307 is swung toward the clamped object 302. At the same time, by means of the fluid pressure within the locking actuation chamber 393 and a resilient force of the locking push spring 395 the locking member 327 is advanced from the unlocking position N to the locking position M, so that its wedge surface 348 engages wedgewise with a wedge receiving surface 349 of the first piston 312. By means of a resultant force of a wedge engagement force of the locking member 327 continuously advanced and of the fluid pressure within the first actuation chamber 313 the first piston 312 is pushed strongly to the clamping position X.

On the other hand, in a hydraulic clamp of the aforementioned wedge engagement type, at the end of clamping actuation the locking member 327 is actuated for locking to the locking position M against a dynamical friction force acting between both the wedge surface 348 and the wedge receiving surface 349. To the contrary, at the beginning of unclamping actuation it is necessary to actuate the locking member 327 for unlocking to the unlocking position N against a statical friction force which is remarkably larger than the aforementioned dynamical friction force. The reason for that is thought to be that the statical friction force is remarkably larger than the dynamical friction force as well as a lubricating oil is squeezed out of a gap between both surfaces 348, 349 by an excessively large surface pressure generated therebetween at the end of clamping actuation so that a metal contact is brought about therebetween.

In the above-mentioned conventional embodiment, since the resultant force of the fluid pressure within the locking actuation chamber 393 and of the resilient force of the locking push spring 395 is used to actuate the locking member 327 for locking, the locking push force is large. Therefore, when the locking member 327 is surely actuated for unlocking, it is necessary to enlarge a sectional area of the second actuation chamber 340 and provide the second piston 339 of a large diameter. Further, it is necessary to set an inclination angle $\alpha$ of the wedge surface 348 at a value as small as possible for surely actuating the locking member 327 for unlocking. Accordingly, the lower portion of the first piston 312 projects rightwards.

As mentioned above, since the diameter of the second piston 339 becomes large and also the length of the first piston 312 becomes long, the hydraulic clamp becomes large in size.

Further, within the duration from the initiation of the clamping actuation indicated by the figure depicted by the alternate long and two short dashes line in FIG. 12 to the starting of the wedge engagement, the lower end surface of the locking member 327 is brought into strong contact with the sealing slide surface (the outer surface) of the first piston 312 by means of the resultant force of the fluid pressure within the locking actuation chamber 393 and of the resilient force of the locking push spring 395. Therefore, the sealing slide surface gets damaged tending to cause a fluid leakage from the first actuation chamber 313. This problem appears as a serious abuse when the thickness of the clamped object such as a metal mould 302 and the like becomes larger. That is, the reason is because a load of the first piston 312 becomes large at the stage of a small swing angle of the clamping arm 307 when the thickness to be clamped becomes large and also a degree of an interference between the sealing slide surface of the first piston 312 and the lower end surface of the locking member 327 becomes large.

SUMMARY OF THE INVENTION

It is an object of the present invention to downsize a fluid clamping apparatus smaller and to prevent a damage of a sealing slide surface of a first piston for clamping.

For accomplishing the aforementioned object, the present invention resides in such a construction that the mechanism for changing over the locking member in the above-mentioned basic construction is constructed as follows.

A locking member is provided with a first pressure receiving surface on which a fluid pressure within a first actuation chamber acts as a pushing force toward an unlocking position and a second pressure receiving surface on which a fluid pressure within the first actuation chamber acts as a pushing force toward a locking position, and the areas of these pressure receiving surfaces are set at a substantially same value. Further, the locking member is pushed toward the locking position by means of a pushing means, and a pushing force of the pushing means is set at a value smaller than an unlocking actuation force of a second cylinder.

The present invention functions as follows.

When a clamp apparatus is changed over from an unclamping condition to a clamping condition, a pressurized fluid is supplied to the first actuation chamber as well as the pressurized fluid is discharged from a second actuation chamber. Thereupon, the fluid pressure within the first actuation chamber acts on a pressure receiving surface of the first piston so as to advance the first piston from the unclamping position to the clamping position.

Since the pressure within the first actuation chamber acts on both the pressure receiving surfaces of the wedge type locking member and the pressure receiving areas of these surfaces are substantially equal, a received force of the locking member in its axial direction is cancelled. Accordingly, the locking member can be advanced from the unlocking position to the locking position by means of a small pushing force of the pushing means, and a wedge receiving surface of the first piston is received by a wedge surface of the locking member. Thereby, even though the fluid pressure within the first actuation chamber abnormally lowers due to a pressure leakage from a pressure supply piping, it is possible to prevent a returning of the first piston from the clamping position to the unclamping position.

Since the present invention is constructed and operates as mentioned above, the following advantages can be provided.

Since the wedge type locking member is changed over to the locking position by means of a small force of the pushing means, an operating force required for changeover to the unlocking position can be small. Therefore, the second piston of the second cylinder can be made small in diameter. Further, since the locking member according to the present invention is so different from the conventional one as not to communicate a clamping force and merely to prevent an unclamping actuation of the first piston, it is possible to decrease a projecting length of the first piston by enlarging an inclination angle of the wedge surface of the locking member. In that way, since the second piston can be made smaller in diameter and also the first piston can be shortened in length, the fluid clamping apparatus can be made small in size.

Further, since a contact force of the locking member against the sealing slide surface of the first piston is provided only by a small force of the aforementioned pushing means, the damage of the sealing slide surface can be prevented and the fluid leakage from the first actuation chamber can be prevented for a long time.

BRIEF DESCRIPTION OF THE DRAWINGS

The above and other objects, advantages and features of the invention will become apparent when considered with the following specification and accompanying drawings wherein:

FIGS. 1 through 5 show a first embodiment of the present invention;

FIG. 2 is a side view of a hydraulic clamp;

FIG. 3 is a plan view of the hydraulic clamp;

FIG. 4 is a vertical sectional side view taken along section line IV—IV in FIG. 3, showing a clamping condition of the hydraulic clamp;

FIG. 5 is a vertical sectional side view showing an unclamping condition of the hydraulic clamp;

FIG. 10 is a vertical sectional side view of a hydraulic clamp;

FIG. 11 is a vertical sectional view taken along section line XI—XI line in FIG. 10.

DESCRIPTION OF THE PREFERRED EMBODIMENTS

Now, embodiments of the present invention will be explained with reference to the accompanying drawings hereinafter.

First Embodiment

FIGS. 1 through 5 show a first embodiment.

Figure 3:
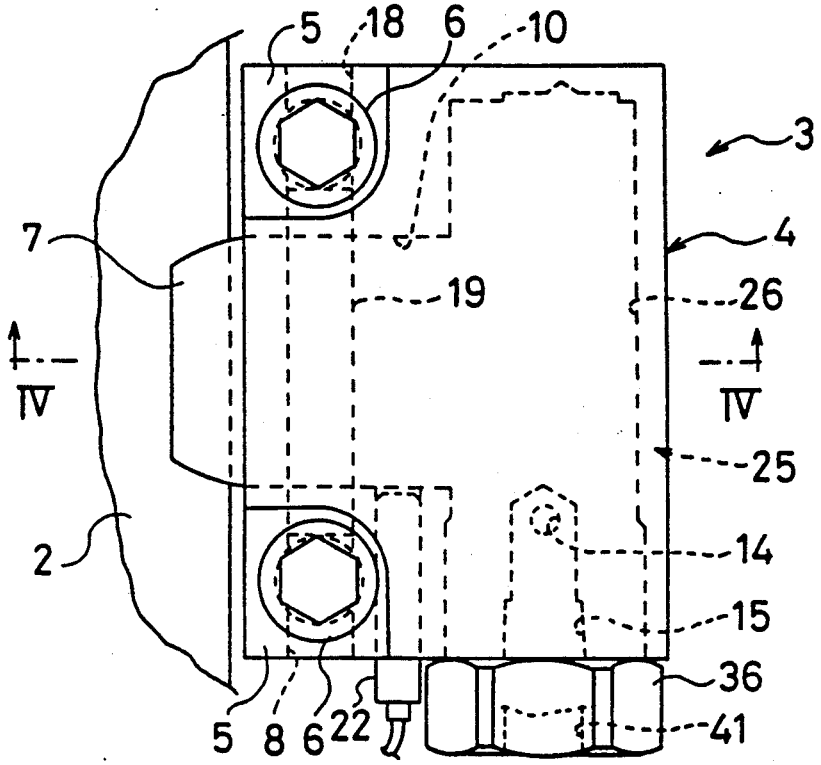
Figure 2:
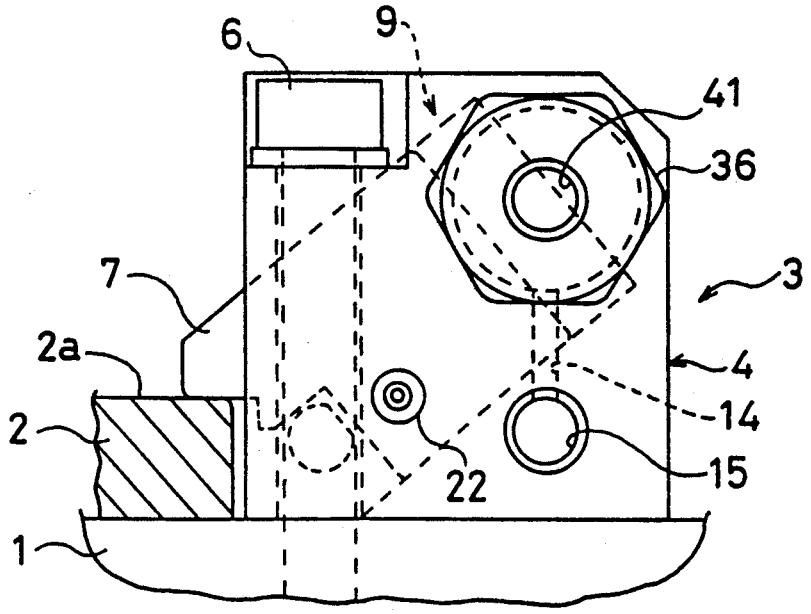

As shown in the side view of FIG. 2 and in the plan view of FIG. 3, a metal mould 2 as a clamped object is fixedly clamped onto a fixed angular table 1 of an injection moulding machine by means of a hydraulic clamp 3 of the single-acting spring-returned type. The hydraulic clamp 3 is fixedly secured to the angular table 1 by means of two bolts 6, 6 through both side walls 5, 5 of its clamp housing 4. A clamping member 7 advanced from the housing 4 is adapted to clamp a clamped area 2*a* of the metal mould 2 from above slantly.

Figure 5:
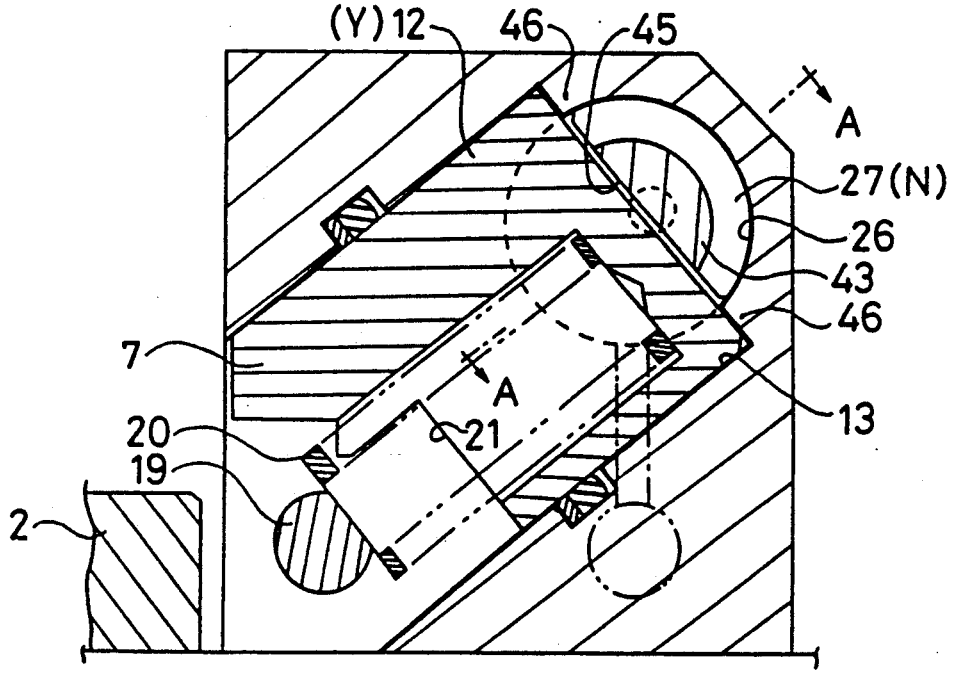
Figure 4:
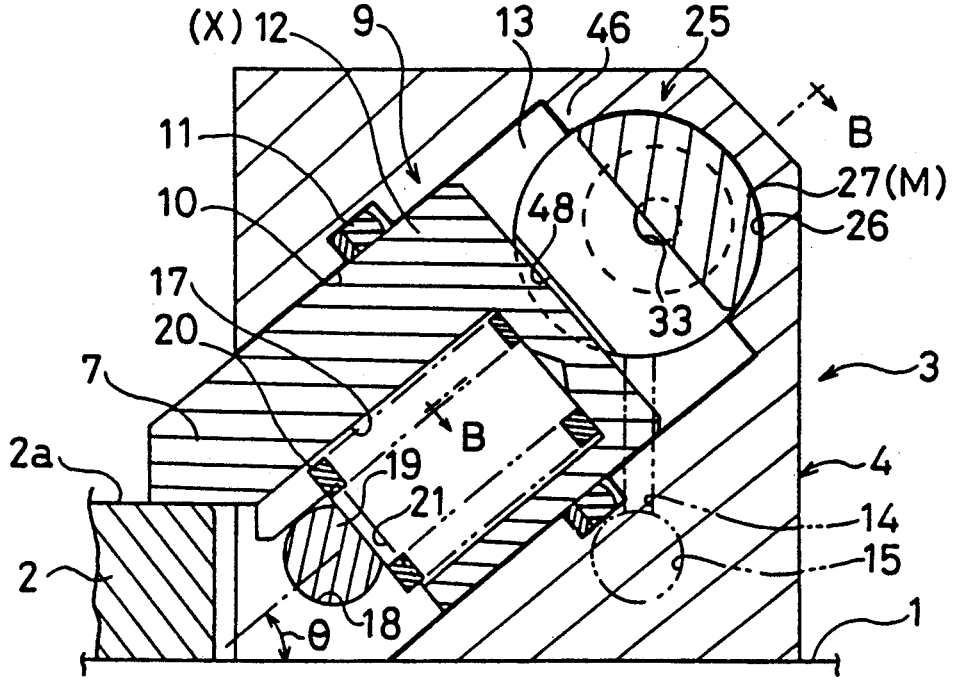

Then, mainly with reference to the vertical sectional side views of FIGS. 4 and 5, a concrete construction of the hydraulic clamp 3 will be explained. FIG. 4 is the sectional side view taken along section line IV—IV in FIG. 3 and shows the clamping condition thereof, and FIG. 5 shows the unclamping condition thereof.

A first cylinder 9 of the hydraulic type is disposed within the housing 4. The first cylinder 9 is provided with a cylinder bore 10 formed so as to extend in a forwardly declining direction, a first piston 12 inserted in a fluid tight relationship into the cylinder bore 10 through a packing 11 and a first actuation chamber 13 formed behind and above the first piston 12. A first oil supply/discharge port 15 communicates with the first actuation chamber 13 through an oil passage 14. The clamping member 7 is formed by a direct protruding (i.e. integral) part of the upper portion of the first piston 12 extending from its front end in the forwardly declining direction and guided by the upper portion of the surrounding surface of the cylinder bore 10.

A spring accommodation recess 17 is formed in the first piston 12 in such a manner as to extend backwards from the front end of the first piston 12. An axis of the spring accommodation recess 17 is arranged to lie below an axis of the cylinder bore 10. Pin insertion holes 18, 18 are formed transversely in the front lower portions of both side walls 5, 5 of the housing 4. A spring retainer pin 19 is so disposed as to cross over both the clamping member 7 and the spring accommodation recess 17, and its opposite end portions are supported by both the pin insertion holes 18, 18. The spring retainer pin 19 is anchored by means of two bolts 6, 6. An unclamping spring 20 is mounted between the rearwardmost wall of the spring accommodation recess 71 and the spring retainer pin 19. Incidentally, the clamping member 7 is provided at its lateral side portions with left and right paired admitance grooves 21 so formed as to be opened in its front surface for preventing interference with the spring retainer pin 19. As shown in FIGS. 2 and 3, a proximity switch 22 for detecting the clamping and unclamping conditions is disposed in one of the side walls 5, 5 of the housing 4 so as to face the cylinder bore 10.

The aforementioned hydraulic clamp 3 operates as follows. When the hydraulic clamp 3 is changed over from the unclamping condition shown in FIG. 5 to the clamped condition shown in FIG. 4, a pressurized oil is supplied from a first oil supply/discharge port 15 into the first actuation chamber 13. Thereupon, the first piston 12 is driven by means of the oil pressure so as to advance from the unclamping position Y to the clamping position X, so that the clamping member 7 is advanced in the forwardly declining direction. Thereby, the clamping member 7 serves to strongly press and fix the metal mould 2 onto the angular table 1. To the contrary, when it is changed over from the clamping condition shown in FIG. 4 to the unclamping condition shown in FIG. 5, the pressurized oil is discharged from the first actuation chamber 13. Thereupon, the first piston 12 is actuated by means of a resilient force of the unclamping spring 20 so as to be retracted in a backwardly acclivious direction, so that the metal mould 2 can be unclamped.

In the aforementioned hydraulic clamp 3, further a clamp locking means 25 is disposed within the rear upper portion of the housing 4. As shown mainly in FIG. 1, the clamp locking means 25 is provided with a locking chamber 26 which is laterally disposed so as to communicate perpendicularly with the first actuation chamber 13, a cylindrical wedge type locking member 27 inserted into the locking chamber 26 so as to be slidable between a locking position M on the right side and an unlocking position N on the left side therein, a pushing spring (a pushing means) 28 resiliently urging the locking member 27 toward the locking position M and a second cylinder 29 of the hydraulic type adapted to push the locking member 27 toward the unlocking position N.

The locking chamber 26 is divided by the locking member 27 into a first chamber portion 31 on the side of the locking position M (right) and a second chamber portion 32 on the side of the unlocking position N (left), and both these chamber portions 31, 32 are communicated with a communication port 33 formed in the locking member 27. The oil pressure within the first actuation chamber 13 acts on a first pressure receiving surface F of the right side surface of the locking member 27 as a leftward pushing force toward the unlocking position N. To the contrary, the oil pressure within the first actuation chamber 13 acts on a second pressure receiving surface S of the left side surface thereof as a rightward pushing force toward the locking position M. Since the pressure receiving areas of both those pressure receiving surfaces F, S are defined equally and both those chamber portions 31, 32 are communicated with each other through the communication port 33, the leftward and rightward oil pressures acting on the locking member 27 from the first actuation chamber 13 are cancelled. Incidentally, the pushing spring 28 is mounted within the second chamber portion 32 of the locking chamber 26 in an offset position relative to the axis of the locking member 27. Thereby, a turning of the locking member 27 is blocked.

The second cylinder 29 is disposed in series to the locking chamber 26 and the locking member 27 and comprises a cylinder bore 37 formed in a cover bolt 36 and a second piston 39 inserted into the cylinder bore 37 through a packing 38 in the oil-tight relationship. It has a second oil supply/discharge port 41 communicated with a second actuation chamber 40 on the right side of the second piston 39. A transmission member 43 is protruded rightwards from the locking member 27 so as to face the second piston 39. The transmission member 43 is disposed offset on the back side remoter from the first piston 12 relative to the locking member 27. The resilient force of the pushing spring 28 is set at a value smaller than an unlocking actuation force acting on the second piston 39 from the second actuation chamber 40.

Next, the operation of the clamp locking means 25 will be explained with reference to FIGS. 1, 4 and 5.

Figure 1A:
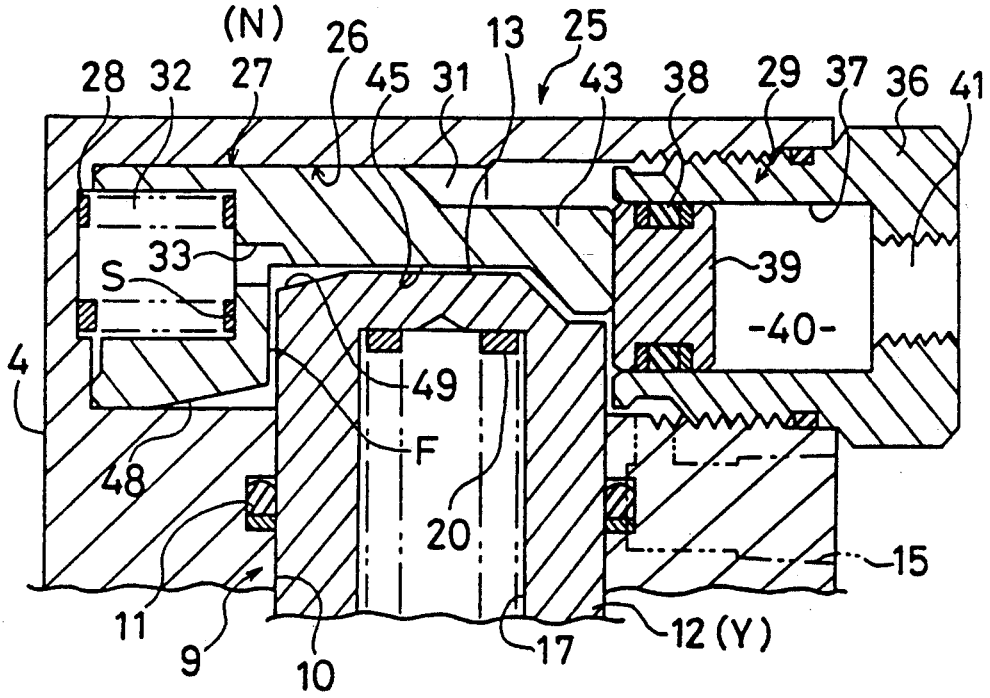
FIG. 1(A) is a sectional view taken along section line A—A in FIG. 5.

Under the unclamping condition shown in FIGS. 1(A) and 5, the pressurized oil within the first actuation chamber 13 is discharged from the first oil supply/discharge port 15, and another pressurized oil is supplied from the second oil supply/discharge port 41 to the second actuation chamber 40. Thereby, the second piston 39 is advanced leftwards so as to change over the locking member 27 to the unlocking position N against the pushing spring 28 as well as the first piston 12 is retracted to the unclamping position Y by means of the unclamping spring 20. Incidentally, the rear portion of the first piston 12 is adapted to be received in an interference prevention groove 45 concaved in the front portion of the locking member 27 and is stopped by a rear wall 46 of the first actuation chamber 13 (refer to FIG. 5).

Figure 1B:
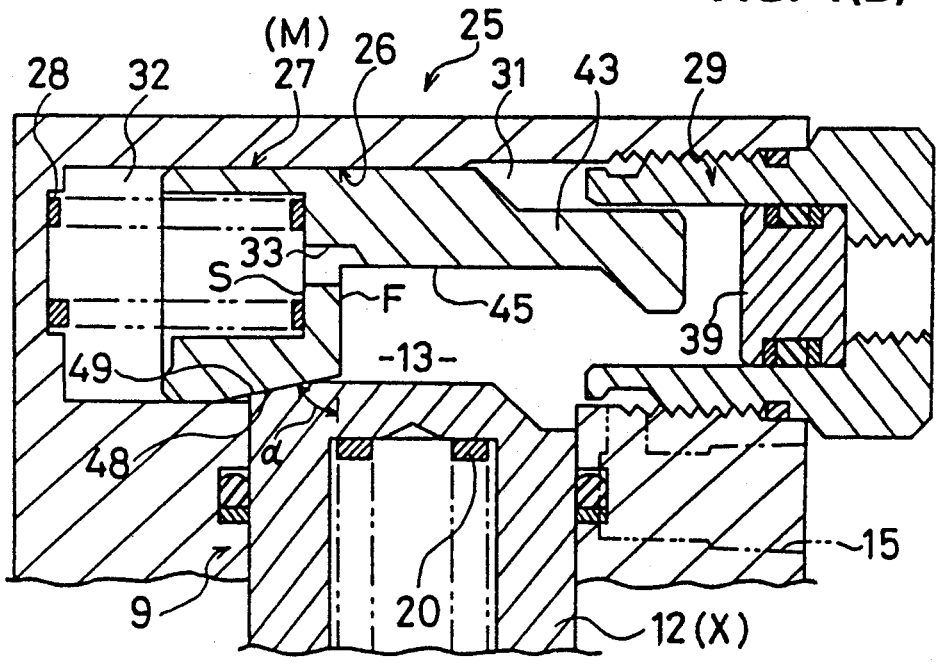
FIG. 1(B) is a sectional view taken along section line B—B in FIG. 4.

When changing over from the unclamping condition to the clamping condition shown in FIGS. 1(B) and 4, the pressurized oil is supplied to the first actuation chamber 13 and the pressurized oil within the second actuation chamber 40 is discharged. Thereupon, by means of the pressurized oil within the first actuation chamber 13 the first piston 12 is advanced to the clamping position X against the unclamping spring 20. Subsequently, the locking member 27 is advanced to the locking position M by means of the resilient force of the pushing spring 28 and the wedge receiving surface 49 of the piston 12 is received by means of the wedge surface 48 of the locking member 27. Thereby, even though the pressurized oil within the first actuation chamber 13 abnormally lowers due to a pressurized oil leakage and the like of the pressurized oil supply piping, the first piston 12 is held at the clamping position X. Incidentally, the symbol $\alpha$ in FIG. 1(B) designates an inclination angle of the wedge surface.

According to the above-mentioned embodiment, the following advantages can be provided.

Since it is unnecessary to provide an oil-sealing packing in the locking member 27, the pushing force of the pushing means 28 is not reduced by a sliding friction of the packing. Therefore, the hydraulic clamp 3 can be kept surely in the locking condition.

Further, since the transmission member 43 is provided between the second piston 39 and the locking member 27 as well as the transmission member 43 is offset on the side remoter from the first piston 12 relative to the locking member 27, the first piston 12 changed over to the unclamping position Y can be received within the interference prevention groove 45. Therefore, the whole length of the hydraulic clamp 3 can be further reduced.

Figure 6:
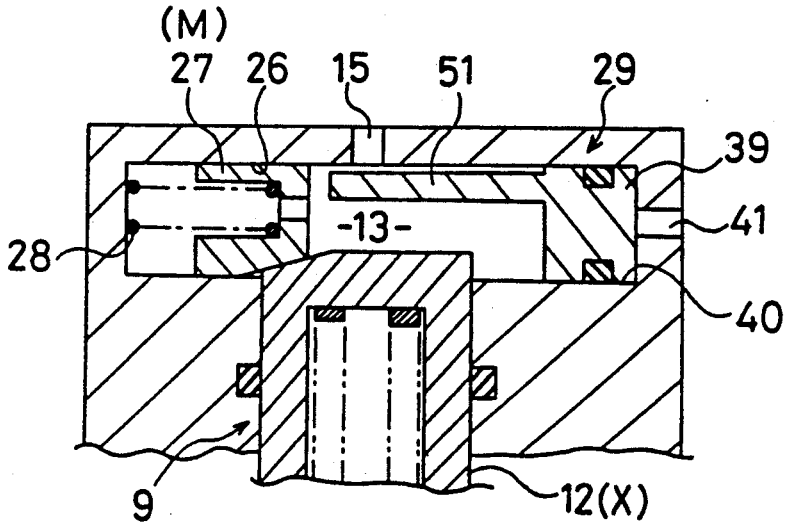
FIG. 6 shows a first variant of the above first embodiment and is a view corresponding to FIG. 1(B)
Figure 7:
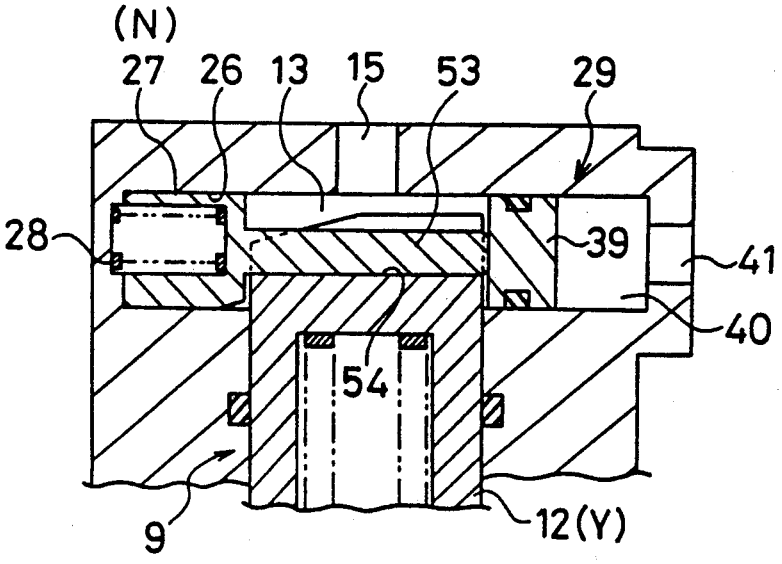
FIG. 7 shows a second variant and is a view corresponding to FIG. 1(A)
Figure 8:
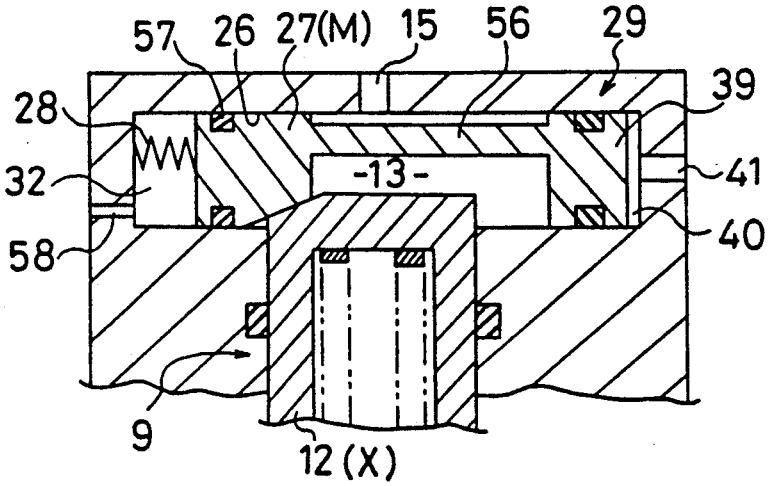
FIG. 8 shows a third variant and is a view corresponding to FIG. 1(B)

FIGS. 6 through 8 show variants of the above-mentioned first embodiment respectively. Incidentally, in the respective variants, the same component parts as those of the first embodiment are designated, in principle, by the same symbols.

First Variant

FIG. 6 shows a first variant. A transmission member 51 of the second cylinder 29 for unlocking is formed as an integral part with the second piston 39 so as to face the locking member 27.

Second Variant

FIG. 7 shows a second variant. A transmission member 53 is formed as an integral part coaxially with the locking member 27, and an interference groove 54 is formed in the first piston 12.

Third Variant

FIG. 8 shows a third variant. The locking member 27 and a transmission member 56 are formed as an integral part with the second piston 39. The locking member 27 is inserted into the locking chamber 26 through a packing 57 in the oiltight relationship. The second chamber portion 32 accommodating the pushing spring 28, one of both the left and right chambers of the locking chamber 26, is communicated with the atmosphere through a vent 58.

The above-mentioned first embodiment can be further modified as follows.

The first cylinder 9 and the second cylinder 29 may be a pneumatic cylinder instead of the hydraulic cylinder, and only the second cylinder 29 may be the pneumatic cylinder.

In the third variant shown in FIG. 8, the pushing means of the locking member 27 may be such a one as to utilize a pressure of a compressed air instead of the spring 28.

Second Embodiment

Figure 9:
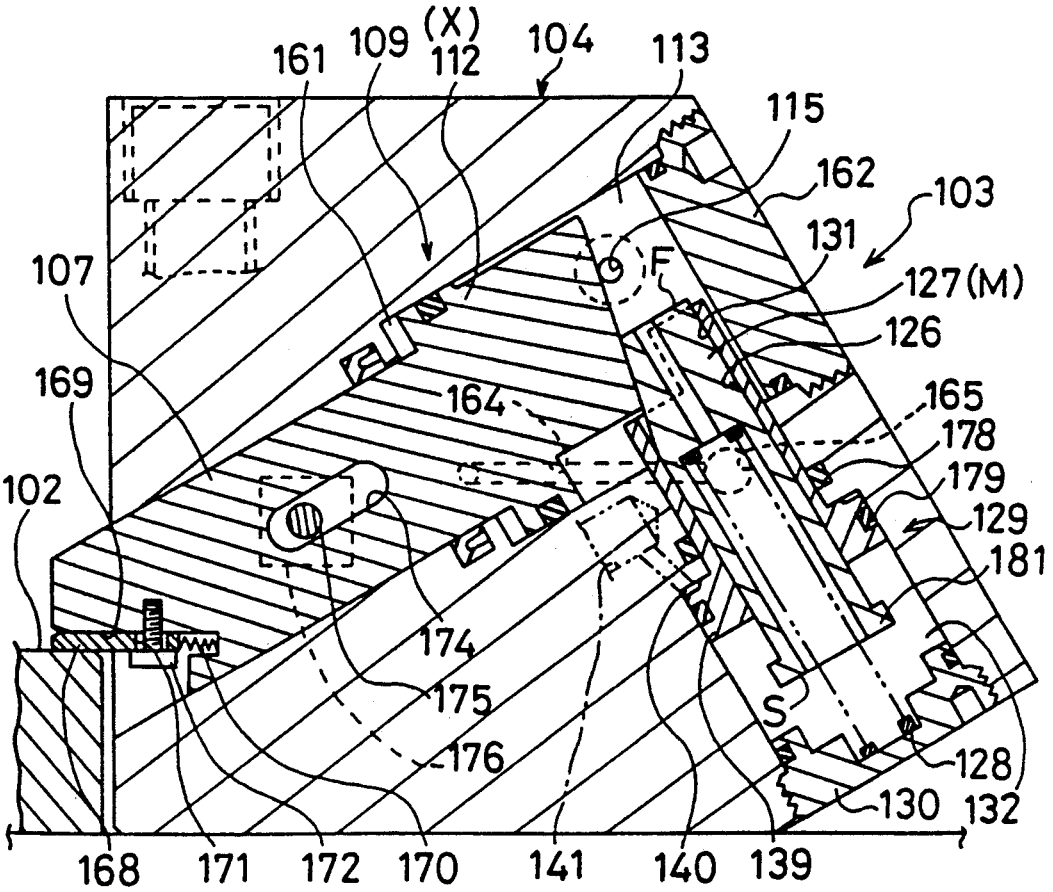
FIG. 9 shows a second embodiment of the present invention and is a vertical sectional side view of a hydraulic clamp.

FIG. 9 shows a second embodiment of the present invention, wherein a hydraulic clamp 103 is of the double acting type. That is, a first actuation chamber 113 for clamping actuation and a third actuation chamber 161 for unclamping actuation are formed on the opposite sides of a first piston 112 of the first cylinder 109 within a housing 104. The rear wall of the first actuation chamber 113 is formed by a cover bolt 162. A first oil supply/discharge port 115 is communicated with the first actuation chamber 113. Then, a third oil supply/discharge port 165 is communicated with the third actuation chamber 161 through an oil passage 164.

Between an upper surface of a metal mould 102 and a clamping member 107 there is interposed a sliding shuttle member 168 so as to be slidable within a certain extent in the fore and back directions. The shuttle member 168 comprises a plated nitrided alloy steel and is inserted into a support groove 169 formed in the lower surface of the clamping member 107 with being resiliently urged forwards by an advancement spring 170. A stopper pin 172 passed through a play through-hole 171 serves to prevent the shuttle member 168 from moving forwards at least a predetermined distance.

When changing over from the clamping condition shown in FIG. 9 to the unclamping condition, the shuttle member 168 operates as follows. When the first piston 112 is actuated so as to retract in the backwardly acclivous direction, firstly a sliding is caused between the shuttle member 168 frictionally fixed to the metal mould 102 and the clamping member 107 and then only the clamping member 107 is actuated backwardly acclivously with the shuttle member 168 being left behind. By means of the first piston 112 continuously actuated so as to retract, the clamping member 107 and the shuttle member 168 are actuated for unclamping in the backwardly acclivous direction, so that the metal mould 102 can be unclamped. Thereby, the unclamping operation can be reliably accomplished.

Incidentally, the clamping condition and the unclamping condition of the hydraulic clamp 103 can be detected by sensing a movement of the pin 175 inserted into an elongated port 174 of the clamping member 107 by means of a limit switch 176.

The locking chamber 126 is formed within the back lower portion of the housing 104, and the locking member 127 accommodated within the locking chamber 126 is adapted to be changed over between the locking position M on the upper side and the unlocking position on the lower side. The locking chamber 126 is divided by means of the locking member 127 into a first chamber portion 131 on the upper side and a second chamber portion 132 on the lower side. A pushing spring 128 is mounted within the second chamber portion 132. The symbol 130 designates a spring retainer. A second piston 139 of a second cylinder 129 is formed in an annular configuration so as to be fitted externally to the locking member 127 and to be slidable through packings 178, 179 within the housing 104 in the oil-tight relationship. The locking member 127 is provided with an unlocking driven portion 181 to be pushed into the second chamber portion 132, and the driven portion 181 is faced to the second piston 139 from below. Incidentally, a second actuation chamber 140 is disposed above the second piston 139 and is communicated with a second oil supply/discharge port 141.

When changing over from the clamping condition shown in FIG. 9 to the unclamping condition, firstly the pressurized oil is supplied to the second actuation chamber 140 so that the locking member 127 is lowered through the driven portion 181 by means of the second piston 139. Then, by discharging the pressurized oil from the first actuation chamber 113 as well as supplying the pressurized oil to the third actuation chamber 161 the first piston 112 is retracted. By the way, the changeover from the unclamping condition to the clamping condition can be effected by the procedure substantially reverse to the aforementioned one.

According to the aforementioned construction, since the locking member 127 and the second piston 139 can be overlapped each other in the axial direction, the axial length of the locking member 127 can be decreased by that overlapped portion.

Third Embodiment

Figure 10:
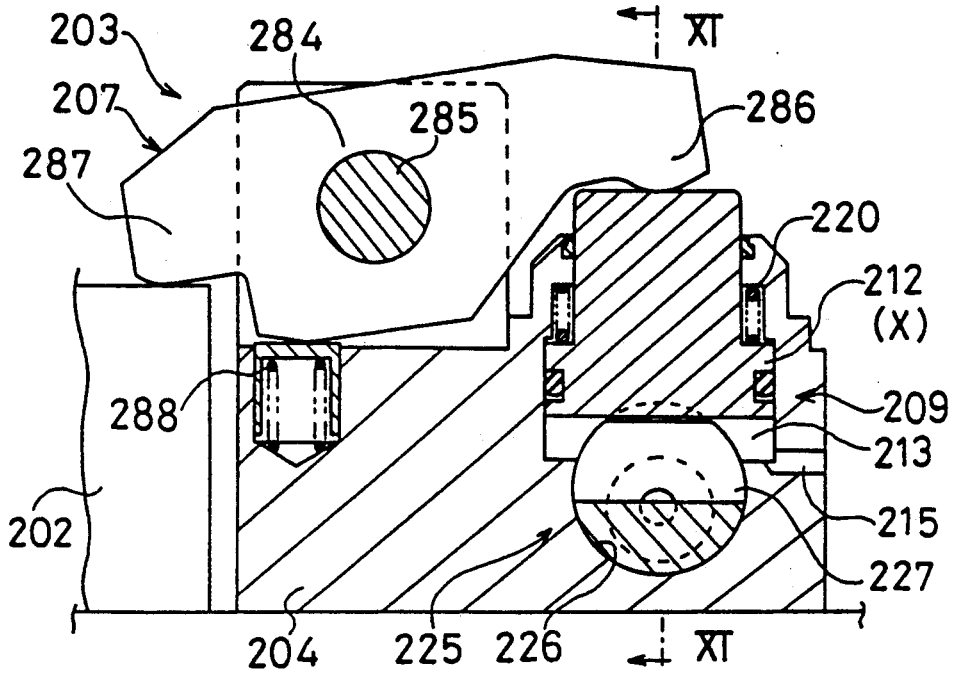
FIGS. 10 and 11 show a third embodiment of the present invention.
Figure 11:
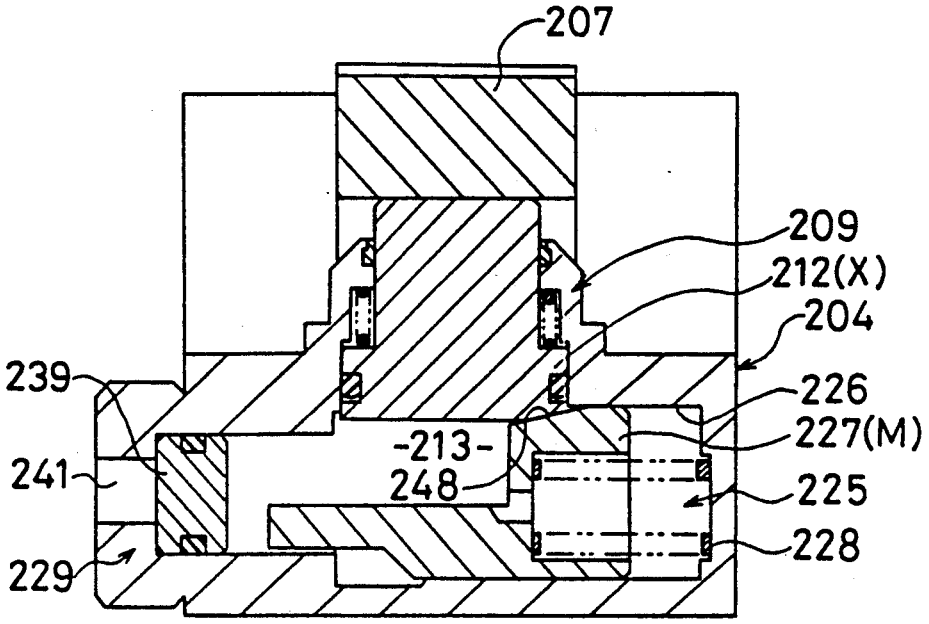
Figure 12:
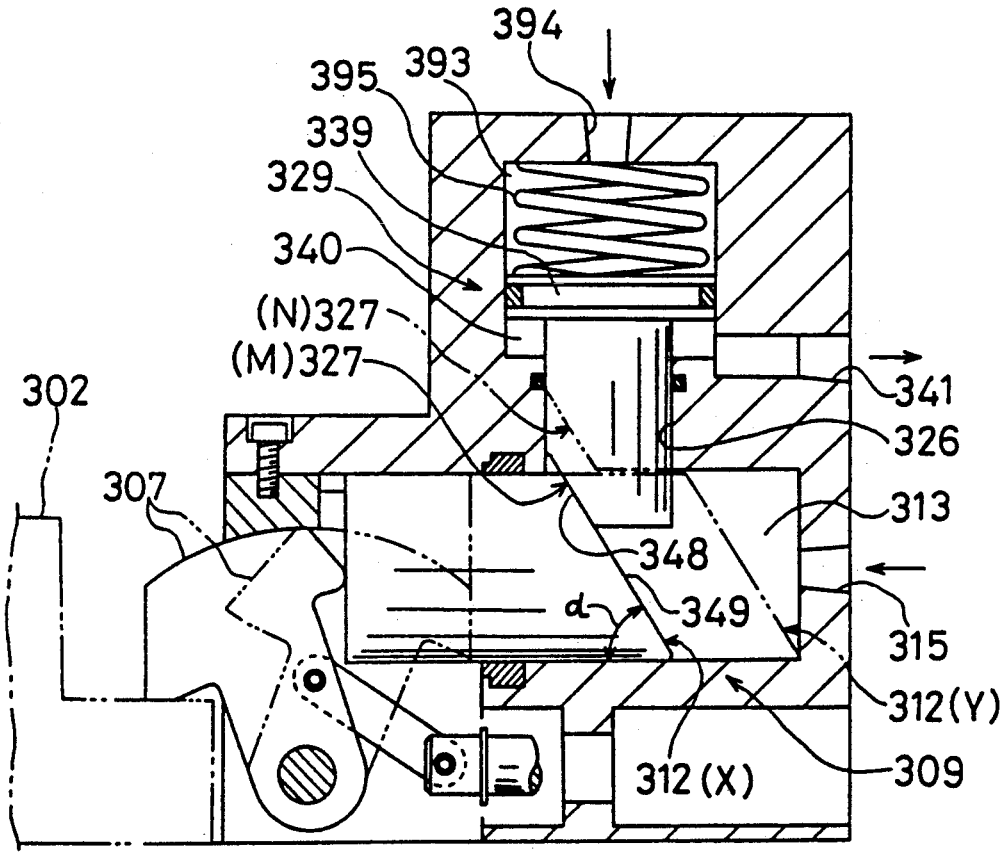
PRIOR ART FIG. 12
FIG. 12 shows a conventional embodiment and is a vertical sectional side view of a hydraulic clamp.

FIGS. 10 and 11 show a third embodiment of the present invention and illustrate a hydraulic clamp 203 of the balance type to which a clamp locking means 225 according to the present invention is applied.

A clamping arm 207 is supported vertically swingably at its fulcrum point 284 by means of the front upper portion of a housing 204 through a pivot pin 285, and a first piston 212 and a first actuation chamber 213 of a first cylinder 209 are disposed below a force application point 286 of the clamping arm 207. A locking chamber 226 communicating with the first actuation chamber 213 is disposed laterally in the lower portion of the housing 204. The symbol 227 designates a locking member 227, the symbol 239 does a second piston and the symbol 241 does a second oil supply/discharge port.

When changing over from the unclamping condition to the unclamping condition shown in FIGS. 10, 11, the hydraulic clamp 203 operates as follows. When the pressurized oil is supplied from a first oil supply/discharge port 215 to the first actuation chamber 213, the first piston 212 is advanced to the clamping position X on the upper side against an unclamping spring 220. Thereby, the clamping arm 207 is actuated to swing, so that its acting point 287 serves to clamp the metal mould 202. The first piston 212 is held at the clamping position X by means of a wedge surface 248 of the locking member 227 advanced to the locking position M by means of the resilient force of a pushing spring 228. Thereby, the clamping arm 207 is held at the clamping position. By the way, the clamping arm 207 can be changed over to the unclamping condition by means of a return spring 288.

It will be apparent that, though a specific embodiments, certain modifications of the present invention have been described in detail, the invention is not limited to the specifically illustrated and described constructions since variations may be made without departing from the principles of the invention.

What is claimed is:

1. A clamping apparatus comprising:

a first cylinder for clamping provided with a first piston and a first actuation chamber, said first piston being advanced from an unclamping position to a clamping position by adjusting a fluid pressure within said first actuation chamber through a fluid pressure introducing/removal means;

a clamping member carried by said first piston so as to be moveable with said first piston between unclamping and clamping positions;

a locking chamber communicated crosswise with said first actuation chamber;

a wedge type locking member having a first pressure receiving surface and a second pressure receiving surface and inserted into said locking chamber so as to be movable between a locking position where said locking member has been advanced into said first actuation chamber and an unlocking position where said locking member has been retracted into said locking chamber;

said first pressure receiving surface serving to move said locking member toward said unlocking position by means of the fluid pressure within said first actuation chamber;

said second pressure receiving surface serving to move said locking member toward said locking position by means of the fluid pressure within said first actuation chamber;

pressure receiving areas of those pressure receiving surfaces being defined substantially equal;

a second cylinder for unlocking provided with a second piston and a second actuation chamber, said second piston shifting said locking member from said locking position to said unlocking position by adjusting a fluid pressure within said second actuation chamber through said fluid pressure introducing/removal means; and a pushing means biasing said locking member toward said locking position, a pushing force of said pushing means being set at a value smaller than an unlocking actuation force of said second cylinder.

2. A clamping apparatus as set forth in claim 1, wherein said locking chamber is divided by said locking member into a first chamber portion on the side of said locking position and a second chamber portion on the side of said unlocking position;

said pushing means is disposed within said second chamber portion, and said second piston is formed in an annular configuration so as to be externally fitted to said locking member; and said locking member is provided with an unlocking driven portion for entering said second chamber portion so that said unlocking driven portion faces the second piston from the unlocking position side.

3. A clamping apparatus as set forth in claim 1, wherein said locking chamber is divided by said locking member into a first chamber portion on the side of said locking position and a second chamber portion on the side of said unlocking position;

said pushing means is disposed within said second chamber portion; and said second piston and said second actuation chamber are arranged in series relative to said first chamber portion so that said second piston faces said locking member.

4. A clamping apparatus as set forth in claim 3, wherein a transmission member is disposed between said second piston and said locking member, and said transmission member is offset to the side remote from said first piston relative to said locking member.

* * * * *